US005620793A

United States Patent [19]

Suzuki et al.

[11] Patent Number: 5,620,793

[45] Date of Patent: Apr. 15, 1997

[54] PRINTING PAPER AND METHOD OF IMAGE FORMATION EMPLOYING THE SAME

[75] Inventors: Akio Suzuki, Yokohama; Masayoshi Takahashi, Chofu; Yoshinobu Shimomura, Yokohama; Tatsuo Takeuchi; Yoshihiro Takada, both of Kawasaki; Mamoru Sakaki, Yamato; Masato Katayama, Yokohama, all of Japan

[73] Assignee: Canon Kabushiki Kaisha, Tokyo, Japan

[21] Appl. No.: 332,369

[22] Filed: Oct. 31, 1994

[30] Foreign Application Priority Data

| | | | |
|---|---|---|---|
| Nov. 5, 1993 | [JP] | Japan | 5-299038 |
| Nov. 5, 1993 | [JP] | Japan | 5-299039 |
| Nov. 5, 1993 | [JP] | Japan | 5-299040 |

[51] Int. Cl.[6] ..... B41M 5/00

[52] U.S. Cl. ..... 428/342; 428/211; 428/331; 428/479.6; 428/511; 428/535; 428/537.5; 428/537.7

[58] Field of Search ..... 428/206, 207, 428/211, 323, 331, 195, 537.5, 341, 342, 479.6, 511, 535, 537.7

[56] References Cited

U.S. PATENT DOCUMENTS

| | | | |
|---|---|---|---|
| 4,664,952 | 5/1987 | Arai et al. | 427/256 |
| 4,686,118 | 8/1987 | Arai et al. | 427/261 |
| 4,758,461 | 7/1988 | Akiya et al. | 428/212 |
| 4,832,984 | 5/1989 | Hasegawa et al. | 427/161 |
| 4,877,680 | 10/1989 | Sakaki et al. | 428/332 |
| 4,965,612 | 10/1990 | Sakaki et al. | 346/1.1 |
| 5,041,328 | 8/1991 | Akiya et al. | 428/212 |
| 5,081,470 | 1/1992 | Kurabayashi et al. | 346/1.1 |
| 5,137,778 | 8/1992 | Nakatsugawa et al. | 428/330 |
| 5,182,175 | 1/1993 | Sakaki et al. | 428/537.5 |
| 5,246,774 | 9/1993 | Sakaki et al. | 428/323 |
| 5,401,562 | 3/1995 | Akao | 428/211 |

FOREIGN PATENT DOCUMENTS

| | | |
|---|---|---|
| 0608799 | 8/1994 | European Pat. Off. . |
| 51-13244 | 2/1976 | Japan . |
| 54-59936 | 5/1979 | Japan . |
| 59-162561 | 9/1984 | Japan . |
| 1-135682 | 5/1989 | Japan . |
| 2-54543 | 11/1990 | Japan . |

OTHER PUBLICATIONS

Dialogue (Database Paperchem 240) 58–09166 with respect to Japanese Patent Document No. JP–A–62162585 (Jul. 18, 1987).

*Primary Examiner*—Pamela R. Schwartz
*Attorney, Agent, or Firm*—Fitzpatrick, Cella, Harper & Scinto

[57] ABSTRACT

A printing paper is provided which is neutral paper as the base paper comprising an ink-penetration retarder on a printing face to retard penetration of liquid ink containing a nitrogen compound, a substance as an internal additive of the paper to absorb ammonia or an ammonium ion released from the nitrogen compound in the ink, and a water-soluble inorganic salt in an amount ranging from 0.01 to 0.2% by weight. Printing methods are also provided which use the above printing paper.

29 Claims, 2 Drawing Sheets

PRINTING PAPER AND METHOD OF IMAGE FORMATION EMPLOYING THE SAME

BACKGROUND OF THE INVENTION

1. Field of the Invention

The present invention relates to printing paper, more particularly to a plain paper type of printing paper useful both for ink-jet printing and for electrophotographic printing without special coating on the printing face.

The present invention also relates to a method of forming an image employing the above printing paper.

2. Related Background Art

The ink-jet printing system, which ejects ink directly onto printing paper, is attracting attention owing to low running cost, less noise, and ease of color printing in comparison with other conventional printing systems.

In an ink-jet printing system, an aqueous ink is employed in ink-jet printing system in view of safety in handling, and printing characteristics. The printing medium for ink-jet printing is required to absorb the ink rapidly, not to cause mixing of superposed different colors of inks, to allow the ink spread appropriately, to allow the ink to form ink print dots in a nearly true circle shape with sharp dot edges at high density, and naturally to be sufficiently white to exhibit contrast of dots.

On the other hand, in electrophotographic printing system, the printing paper is required to have appropriate surface electric resistance and appropriate surface smoothness, to have satisfactory toner-transferring properties, to cause little paper dust, not to cause defects of images by adhesion of paper dust on a photosensitive member and an electrostatic charging roll, etc., to be attracted well to the transfer drum, and so forth.

Ink-jet printing paper for exclusive use for ink-jet printing is disclosed in JP-A-1-135682 to satisfy the above requirements for the ink-jet printing system. However, for monocolor printing and business color printing by ink-jet system, use of inexpensive usual plain paper is desired like the one generally used in electrophotographic printing.

On the other hands, in electrophotographic printing, neutralized paper has come to be used in place of conventionally used acidic paper for improvement in storability and other purposes. JP-A-51-13244, JP-A-59-162561 and JP-A-2-54543, for example, disclose neutralized paper as toner-transfer paper having excellent electrophotographic printing characteristics.

The conventional plain paper for electrophotographic printing, when used for ink-jet printing, has disadvantages such that ink absorbency is so low that ink spreads out unnecessarily if a large amount of ink is applied, and that the ink is absorbed along paper fibers to result in unsharpness of the ink dot shape.

For offsetting such disadvantages, the inventors of the present invention proposed previously a specified ink for ink-jet printing and an ink-jet printing method employing the ink. In this ink an amount of a high-boiling organic solvent which serves prevention of drying and clogging of ink-ejection nozzles is decreased, and a nitrogen compound as a dissolution aid for the dye such as ammonia, urea, and their derivatives, aminoalcohols, alkylamines, and amino acids is contained.

When toner-transfer paper, which is made of neutralized plain paper and widely used in electrophotographic printing, is used for ink-jet printing, the black ink used in the ink-jet printing tends to develop brown color on the paper, the phenomenon being called "bronzing". The above ink containing the nitrogen compound exhibits significant bronzing in ink-jet printing, disadvantageously.

The neutralized paper, when used for electrophotographic printing, has not necessarily satisfactory properties, and cannot be free from disadvantages of paper dust formation, abrasion of the photosensitive drum, fixing rolls, paper-delivery rolls, etc., and insufficient attraction of paper by the transfer drum.

Under such circumstances, with popularization of ink-jet printing system owing to its advantages, the printing paper is earnestly desired which is useful both for electrophotographic printing system and for ink-jet printing system.

SUMMARY OF THE INVENTION

The present invention intends to provide a plain paper type of printing paper useful both for ink-jet printing system and for electrophotographic printing system, in particular, to printing paper which has no special coating on the printing face and does not cause bronzing in ink-jet printing even at a high density print portion where a larger amount of ink is applied.

The present invention also intends to provide an image-forming method employing the above printing paper, including ink-jet printing methods and electrophotographic printing methods.

The objects above can be achieved by the present invention as follows.

According to the present invention, there is provided a printing paper which is a neutralized paper as the base paper, comprising an ink-penetration retarder on a printing face to retard penetration of liquid ink containing a nitrogen compound, a substance as an internal additive of the paper to absorb ammonia or an ammonium ion released from the nitrogen compound in the ink, and a water-soluble inorganic salt in an amount ranging from 0.01 to 0.2% by weight.

According to the present invention, there is also provided a printing paper which is a neutral paper as the base paper; comprising a material, on a printing face, selected from the group consisting of casein; starch; cellulose derivatives including carboxymethylcellulose and hydroxyethylcellulose; hydrophilic resins capable of being swollen by the ink, including polyvinyl alcohols, polyvinylpyrrolidones, sodium polyacrylate and polyacrylamides; resins having both a hydrophilic moiety and a hydrophobic moiety in the molecule including SBR latexes, acrylic emulsions, styrene-maleic acid copolymer, styrene-acrylic acid copolymer; water repelling substances including silicone oils, paraffin waxes, and fluorine compounds; and sizing agents, at least one of synthetic aluminum silicate and a kolinite as an internal additive, and a water-soluble inorganic salt in an amount ranging from 0.01 to 0.2% by weight.

According to the present invention, there is still provided an image-forming method by ink-jet printing system comprises ejecting droplets of ink containing a nitrogen compound through an orifice in accordance with a printing signal onto the printing paper as defined above, respectively.

According to the present invention, there is provided further an image-forming method by electrophotographic printing system comprises transferring electrostatically a toner image formed on a photosensitive member onto the printing paper as defined above, respectively, and fixing the transferred toner image by heat and/or pressure on the printing paper to form a printed image.

DESCRIPTION OF THE PREFERRED EMBODIMENTS

Figure 1:
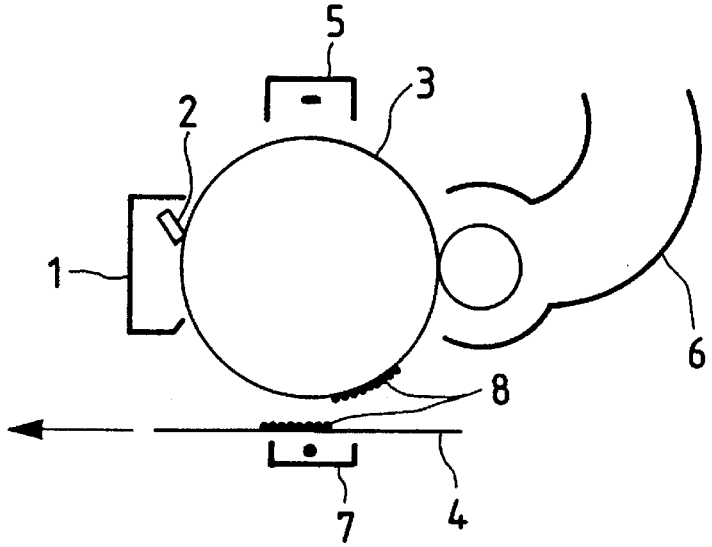
FIG. 1 illustrates a copying step according to an electrophotographic printing system.

A plain paper type printing paper useful both for ink-jet printing system and for electrophotographic printing system is obtained in the present invention by employing a neutralized paper as the base paper, which comprises an ink-penetration retarder on a printing face to retard penetration of liquid ink containing a nitrogen compound, a substance as an internal additive of the paper to absorb ammonia or an ammonium ion released from the nitrogen compound in the ink, and a water-soluble inorganic salt in an amount ranging from 0.01 to 0.2% by weight without special coating on the printing face. This printing paper does not cause bronzing, in ink-jet printing, even at a high density printing area where a larger amount of ink is applied. In particular, it has been found that bronzing in ink-jet printed image can be suppressed sufficiently by adjusting the aqueous inorganic salts content in the printing paper.

The printing paper employed in the present invention is made by a conventional paper-making process from chemical pulp, e.g., LBKP, NBKP, etc., a sizing agent, and a filler as the main components and additionally necessary paper-making auxiliary agents. The pulp may contain mechanical pulp, or a regenerated waste paper pulp additionally. Otherwise the mechanical pulp or the waste paper pulp may be the main constituent thereof without any disadvantage.

The sizing agent incorporated in the paper includes rosin sizes, alkyl ketene dimers, alkenylsuccinic anhydrides, petroleum resin sizes, epichlorohydrin, cationic starch, acrylamide, etc. In electrophotographic printing system, a sizing agent having a smaller free surface tension impedes the fixation of a toner resin on the paper. Therefore, the sizing agent is suitably selected depending on the toner used.

The printing paper of the present invention is obtained by treating further the above printing paper for sizepress coating at the printing face with a usual surface coating material such as starch to improve the surface strength and the printing characteristics of the paper.

The printing paper of the present invention is adjusted to have a water-extract pH of not lower than 6, preferably not lower than 7. The water-extract pH herein is measured by immersing about 0.1 g of a test piece specified in JIS-P-8133 in 7 ml of distilled water, and measuring the pH of the extract water according to JIS-Z-8802. At the pH outside the above range, the long-term storability of the printing paper deteriorates, and an incomplete coloring ability of the dye of the ink may be exhibited.

The surface pH of the printing paper is adjusted, in the present invention, finally by the aforementioned size press treatment. The sizepress coating solution preferably contains a cationic compound to bring the pH into the above range.

The cationic compound in the present invention has, in the main chain or the side chain thereof, a functional group such as primary, secondary, and tertiary amino radicals, quaternary ammonium, pyridyl, pyridinium, imidazolyl, imidazolinium, sulfonium, phosphonium, and the like, preferably strong acid salts thereof. Such cationic compounds include homopolymers of cationic vinyl compounds such as polyvinylamine, polyallylamine, polydiallylamine, polydimethylaminoethyl methacrylate and salts thereof; and cationically-modified polyvinyl alcohol, polyvinyl-pyrrolidone, polyacrylamide, etc. modified by partially copolymerizing the above functional vinyl monomer with another vinyl monomer; cationized hydroxyethyl-cellulose and cationized starch having the above cationic functional group bonded to the functional group, e.g., hydroxyl in the molecule.

The printing paper of the present invention is adjusted firstly to be suitable for electrophotographic printing.

For this purpose, the surface electric resistance (JIS-C-2111 (20° C./65% RH)) is preferably in the range of from $10^9$ to $10^{12}$ Ω. The surface electric resistance outside this range may cause incomplete transfer and incomplete separation of the toner from the drum.

In view of the deliverability and the curling tendency, the printing paper has preferably a basis weight (JIS-P-8124) ranging from 60 to 90 g/m$^2$, a density (JIS-P-8118) ranging from 0.6 to 0.8 g/m$^3$, the water content (JIS-P-8127) in a paper-machine ranging from 3.5 to 7% by weight, the stiffness (JIS-P-8143) ranging from 50 to 130 cm$^3$/100 in the MD direction, and from 25 to 100 cm$^3$/100 in the CD direction, the whiteness degree (JIS-P-8123) of not lower than 75%, the opacity (JIS-P-8138) of not lower than 80%, and the surface smoothness (JIS-P-8119) ranging from 10 to 160 seconds.

A first feature of the present invention is that the penetration-retarding agent is contained in the printing face of the printing paper formed as described above. The penetration of ink applied on the surface into the interior of the printing paper of the present invention is retarded by about 0.01 to several seconds due to the action of the penetration-retarding agent above, so that the ink penetrates into the paper after most of the low-boiling solvents such as water has been evaporated. Consequently, the ink does not run on the printing paper face unnecessarily, thereby allowing the dye to stay at or near the printing face and to form dots with high contrast.

The penetration-retarding agent includes casein, starch; cellulose derivatives, e.g., carboxymethylcellulose, and hydroxyethylcellulose; hydrophilic resins capable of being swollen by the ink, e.g., polyvinyl alcohols, polyvinylpyrrolidones, sodium polyacrylate, and polyacrylamides; resins having both a hydrophilic moiety and a hydrophobic moiety in the molecule, e.g., SBR latexes, acrylic emulsions, styrene-maleic acid copolymers, and styrene-acrylic acid copolymers; water-repelling substances, e.g., silicone oils, paraffin waxes, and fluorine compounds, and the aforementioned sizing agents. Such a material is applied in an amount ranging approximately from 0.1 to 3 g/m$^2$ on the surface of printing paper.

Within the above range, the ink fixability is not impaired significantly since the ink penetration-retarding effects is retained and the ink composed of evaporation residue containing a non-volatile solvent such as polyhydric alcohol penetrates into interior of the paper and is absorbed.

A second feature of the present invention is that an adsorbent substance, which is capable of adsorbing ammonia or an ammonium ion that is released from the nitrogen compound in the ink and accelerates the bronzing phenomenon, is contained internally in the printing paper.

The adsorbent substance includes fillers such as fine powdery silicic acid, aluminum silicate, diatomaceous earth, kaolin, kaolinite, halloysite, nacrite, dickite, pyrophylite, sericite, titanium dioxide, bentonite, and activated clay; polymers such as homopolymers of acrylic or methacrylic monomers and copolymers thereof with other monomers, homopolymers of α,β-unsaturated monomer, e.g., maleic acid, methacrylic acid, etc. and copolymers with other monomers, sulfo group-containing polymers, esters of polybasic carboxylic acid with polyhydric alcohol, acidic cellulose derivatives modified with polybasic carboxylic acid, and alkali metal salts (e.g., sodium and potassium salts) of the above polymers; surfactants such as sodium laurylsulfate, sodium cetylsulfate, sodium polyoxyethylenelauryl ether sulfates, sodium laurylphosphate, sodium polyoxyethylenelauryl ether phosphates, alkylbenzenesulfonic acids, and alkyl sulfosuccinic acids; and so forth. Particularly preferred are synthetic aluminum silicate and kaolinites in the present invention.

In preferred embodiments of the present invention, the neutralized paper-based printing paper contains internally an adsorbent substance in an amount ranging from 4 to 9%, preferably from 6 to 8% by weight for adsorbing ammonia or an ammonium ion which is released from a nitrogen compound contained in the ink-jet printing ink and accelerates bronzing. At the adsorbent substance content of lower than 4% by weight, feathering and bronzing are liable to occur in ink-jet printing, while, at the content exceeding 9% by weight, scratching or abrasion of the drum and fixation rolls, and insufficient attraction of the paper by the transfer drum (photosensitive member) are liable to occur in electrophotographic printing.

In the above preferred embodiments, ink-jet printing paper is provided by incorporation of an adsorbent substance for adsorbing the ammonia or ammonium ion released from a nitrogen compound in the ink in a specified range of not less than 4% by weight, whereby ink-jet printing can be conducted by use of an ink containing a nitrogen compound and use of neutralized printing paper with retention of the advantages of ink-jet printing with excellent printing quality without bronzing.

The printing paper of the present invention is not greatly different from the conventional neutral PPC paper in surface state and physical properties except the printing characteristics. The incorporation of the aforementioned adsorbent substance in a limited amount of not more than 9% by weight prevents scratching or abrasion of the drum and the fixation rolls, and enables sufficient attraction of the paper sheet to the transfer drum in image formation by electrophotographic printing.

Thus the printing paper of the present invention is useful with excellent properties both for toner-transfer printing by electrophotographic printing and for printing by ink-jet.

A third feature of the present invention is to control the water-soluble inorganic salt content in the above printing paper in the range of from 0.01 to 0.2% by weight. Usually, plain paper for electrophotographic printing contains little amount of water-soluble salts. In the present invention, a water-soluble salt is incorporated at or after the paper sheet formation process of the plain paper. The salt may be any inorganic salt which is dissolved and readily dissociated in water.

The water-soluble inorganic salt may be incorporated by any method. For example, in the paper sheet formation process, the content of the water-soluble inorganic salt in the paper can be controlled by adjusting the amount of the salt in the sizepress coating solution, or after the paper sheet formation, the content can be adjusted by coating of the paper sheet with a water-solution containing a controlled amount of a water-soluble inorganic salt in the above-mentioned range of from 0.01 to 0.2% by weight.

Of the water soluble inorganic salt, any one of sodium chloride, magnesium chloride, and potassium chloride is particularly preferred for prevention of bronzing phenomenon in ink-jet printing. The content of the inorganic salt is preferably in the aforementioned range. With the salt content of less than 0.01% by weight, toner-transfer is defective undesirably because of insufficient transfer current in electrophotographic printing, while, with the salt content of more than 0.2% by weight, bronzing occurs in ink-jet printing and toner-transfer is incomplete because of insufficient intensity of transfer electric field in electrophotographic printing.

For formation of ink-dots with uniform and sharp edges and appropriate running of ink on the printing paper with high dot density (formation of printed image with high image quality), it is desirable to constitute the ink and the printing paper such that the ink droplets deposited on the printing face are not absorbed instantaneously into the paper but are absorbed after a solvent in the ink is evaporated off in some extent at the surface of the printing paper.

The printing paper of the present invention is based on neutralized paper, and the variation of the wild formation portion of the paper is not more than 6%, and the opacity of the paper is not less than 85% in consideration of the structure of the printing paper.

The thickness portion of the printing paper sheet, which is called wild formation, can be measured by a wild-formation tester employing laser beam. The wild-formation means a degree of uniformity of a fiber formation which constitutes paper. The variation ratio of the wild formation, which is an index of the wild formation of the printing paper, is estimated from the breadth of the thin portions of the printing paper and the distribution of the portions, whereby the percentage of the thin portion in the printing paper is shown. Specifically, the variation ratio is shown by the ratio of the standard variation of the measured total transmittance to the average transmittance of the paper to the laser beam. The variation ratio is preferably not more than about 6%, more preferably not more than 4.5% to obtain ink-jet printing paper which gives printing without feeling of density irregularity.

Figure 3:
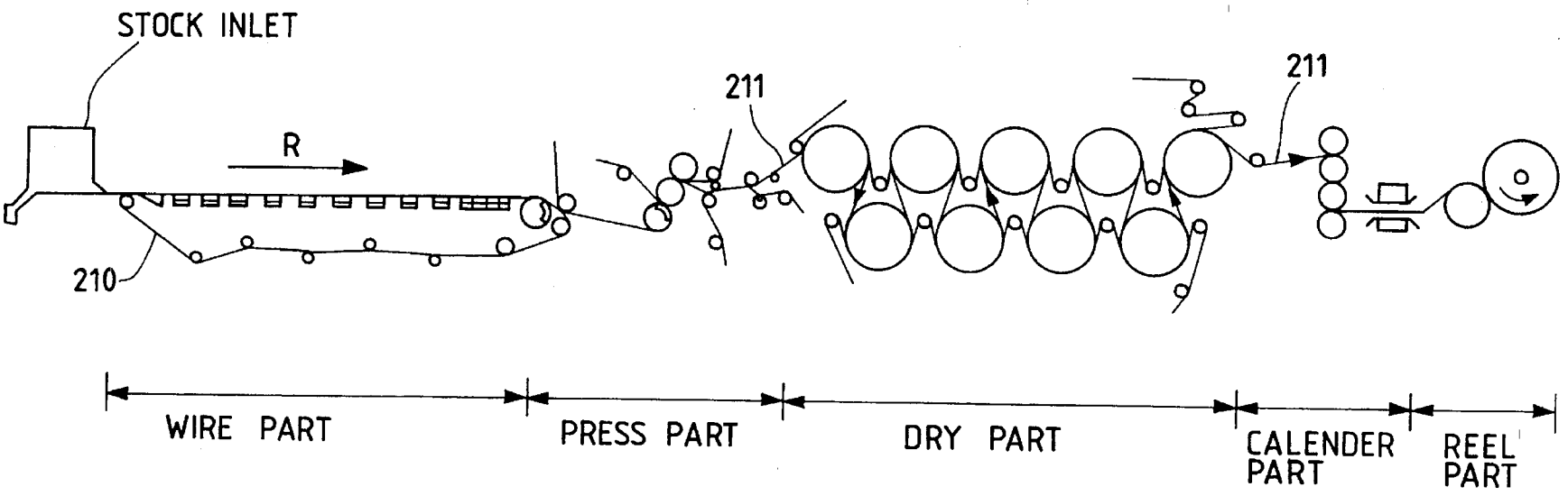
FIG. 3 illustrate schematically constitution of a common paper machine used in the present invention.

The surface roughness of the printing paper, which affects the uniformity of the toner transfer in electrophotographic printing, is adjusted at the calender part of the paper machine shown in FIG. 3. The surface roughness of the paper is adjusted to have the surface smoothness, according to the method of J.TAPPI No.5B, of preferably not less than 80 seconds, more preferably not less than 95 seconds. However, in order to adjust the variation of the friction coefficient between the printing paper sheet to attain stable feeding of the printing paper into the printing apparatus, the surface smoothness is preferably not more than 200 seconds, more preferably not more than 160 seconds.

Regarding the wild formation of the paper sheet, the shape, the size and the number of the thickness variation portions depend on the paper machine used for the paper sheet formation. Generally, uniform images can be obtained with the wild formation variation ratio of 6% or less. However, in the case where the extremely thin portion is 0.5 to 2 mm in diameter (as circle shape) which is the minimum visible size for human eyes, the density variation of printed images is remarkable, even with the wild formation ratio of lower than 6%. Therefore, the number of the wild formation need to be controlled to be not more than one per $cm^2$ by adjusting the operation conditions of the paper machine such as wire vibration degree and drainage speed.

In production of printing paper sheets by means of a Fourdrinier paper machine, the wire speed is adjusted to be not higher than 300 m/sec to raise the apparent drainage speed and to prevent the wild formation of the paper sheet. In such a case, the printing paper sheet has wild formation of 10 mm or larger in diameter. The paper-making conditions need to be selected to avoid wild formation having extremely thin portion.

Another method of improving the apparent wild formation of the paper sheet is to raise the transparency of the printing paper without changing the operation conditions of the paper machine. This method, however, cannot give the desired surface smoothness of the printing paper of the present invention, resulting in non-uniformity of the ink density. Furthermore, the raise of the transparency of the paper sheet causes print-through to impair greatly the quality of the color image. Accordingly, the printing paper of the present invention has opacity of preferably higher than 85%, more preferably higher than 90% according to JIS-P-8138. At such an opacity level, the aforementioned wild formation variation ratio can be attained.

In electrophotographic printing system, if the thickness difference between the wild formation portion and the other portion is 15 μm or more, the print density of solid printing at the wild formation portion is significantly low owing to the difference of toner-transfer properties. To prevent irregularity of printing, the thickness of the printing paper needs to be made uniform. The surface smoothness is preferably about 80 seconds or more, more preferably about 95 seconds or more for the desired transfer of electrophotographic images.

However, printing paper sheets having a basis weight of less than 75 g/m$^2$ and a surface smoothness of 160 seconds or more causes multiple paper sheet feeding in the electrophotographic apparatus disadvantageously. The printing paper sheet having a basis weight ranging from 75 to 210 g/m$^2$ may causes the same phenomenon if the paper sheet is finished to the surface roughness of 200 seconds or more. The printing paper which has been finished to the surface smoothness of 200 seconds or more has excessively high density of the paper sheet to have remarkably impaired ink absorbency.

One simple method of raising the surface smoothness of the printing paper is to raise the water content of the paper to be higher than 6%. However, in an electrophotographic system or an ink-jet printing system, the printing paper is rarely used at the equilibrium water content of paper sheet production. In order to decrease the variation of the properties of the printing paper sheet itself depending on environment, the paper sheet is preferably produced to have a water content ranging from 4 to 5% by weight.

The printing paper of the present invention has preferably a Stöckigt sizing degree ranging from 16 to 40 seconds. If the Stöckigt sizing degree is too low, an ink-droplet may run over, thereby sharp images and characters are difficultly formed, and if too high, an ink is difficultly dried, since an ink is not adsorbed in the printing paper for long time.

The printing paper of the present invention contains internally an adsorbent substance for adsorbing ammonium or an ammonium ion formed from the nitrogen compound in the ink. Therefore, the printing paper is advantageously used in ink-jet printing employing a nitrogen compound-containing ink and neutralized paper with excellent printing quality without bronzing.

The printing paper of the present invention is not greatly different from conventional neutral PPC paper in the surface shape and physical properties except for the printing characteristics, and therefore is useful both for toner-transfer printing in electrophotographic system and for ink-jet printing.

The ink employed for the ink-jet printing contains as the printing agent a water-soluble dye, e.g., direct dyes, acid dyes, basic dyes, reactive dyes, and food colors, etc., a disperse dye, a pigment, or the like. Of these, acid dyes and the direct dyes are widely used. Such a printing agent is contained in the ink in an amount of from about 0.1 to about 20% by weight of the ink. The solvent for the ink is usually water or a mixed solvent of water with a water-soluble organic solvent. Particularly preferred solvents are mixed solvents composed of water and water-soluble organic solvents, containing a polyhydric alcohol and the like which are effective for prevention of drying of the ink. The ink which contains an acid dye or a direct dye usually contains, as the dissolution aid for the dye, a nitrogen compound such as ammonia (ammonium ion), urea or its derivatives, aminoalcohols, alkylamines, and amino acids.

The dye used for the ink may be any known conventional acidic dye or a direct dye. Particularly preferred dye is exemplified by the black dyes shown below:

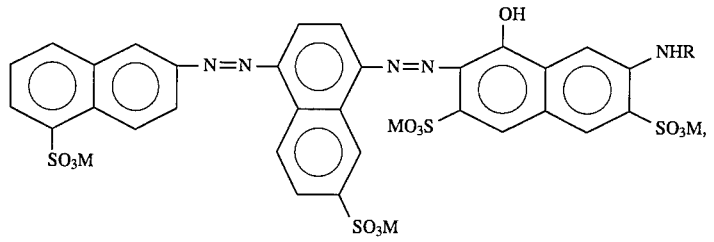

(1)

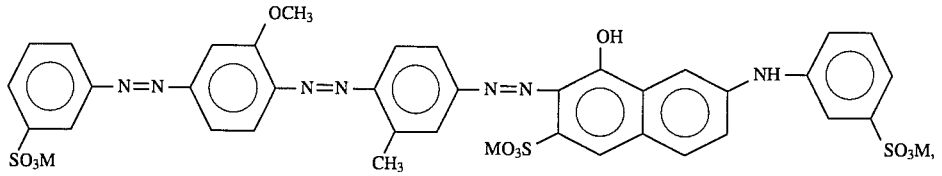

(2)

-continued

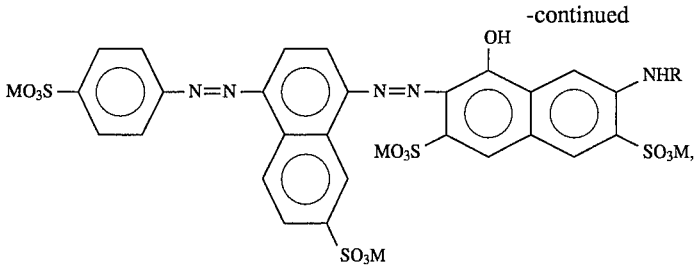

(3)

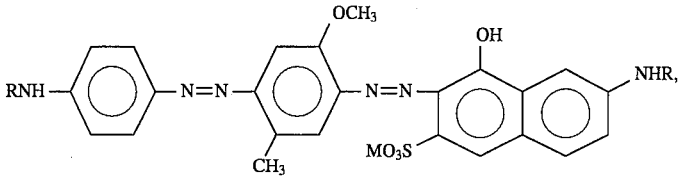

(4)

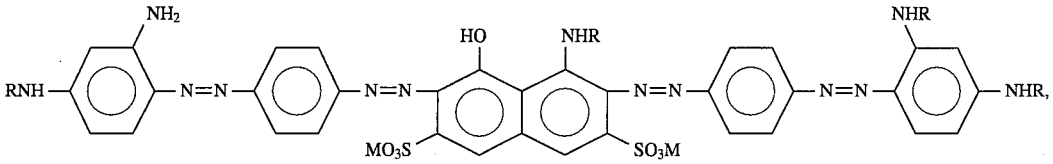

(5)

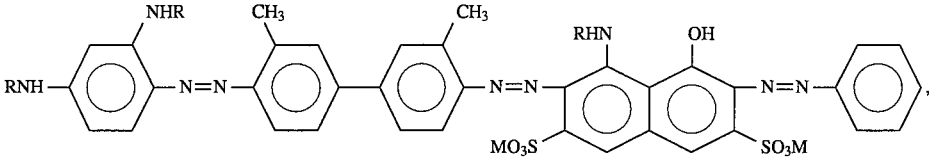

(6)

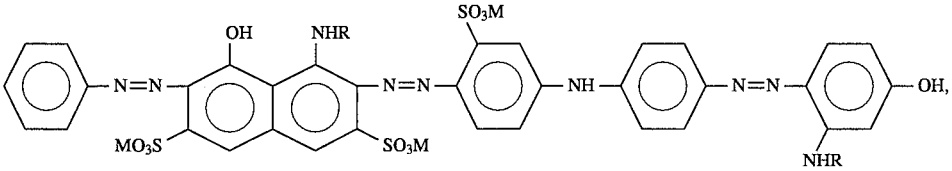

(7)

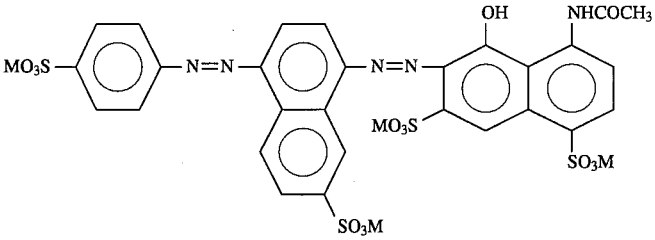

(8)

and

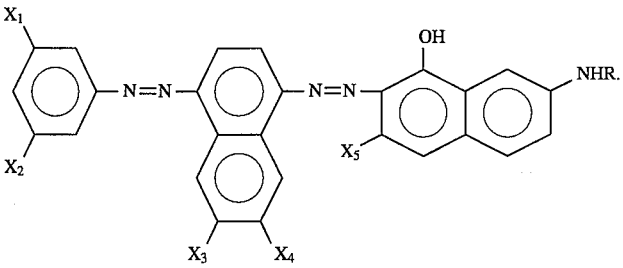

(9)

In the formulas, M is Na or Li; R is H or alkyl; $X_1$ to $X_5$ are independently H, $SO_3Y_1$ or $COOY_2$, $Y_1$ and $Y_2$ being independently Na, Li, K, or $NH_4$.

The printing paper of the present invention is useful in any ink-jet printing system in which ink droplets are ejected by a driving mechanism through a nozzle to conduct printing. A typical example is disclosed in JP-A-54-59936, in which ink receives thermal energy to change its volume abruptly by bubbling and the change of the state gives driving force to eject the ink form the nozzle.

Figure 2:
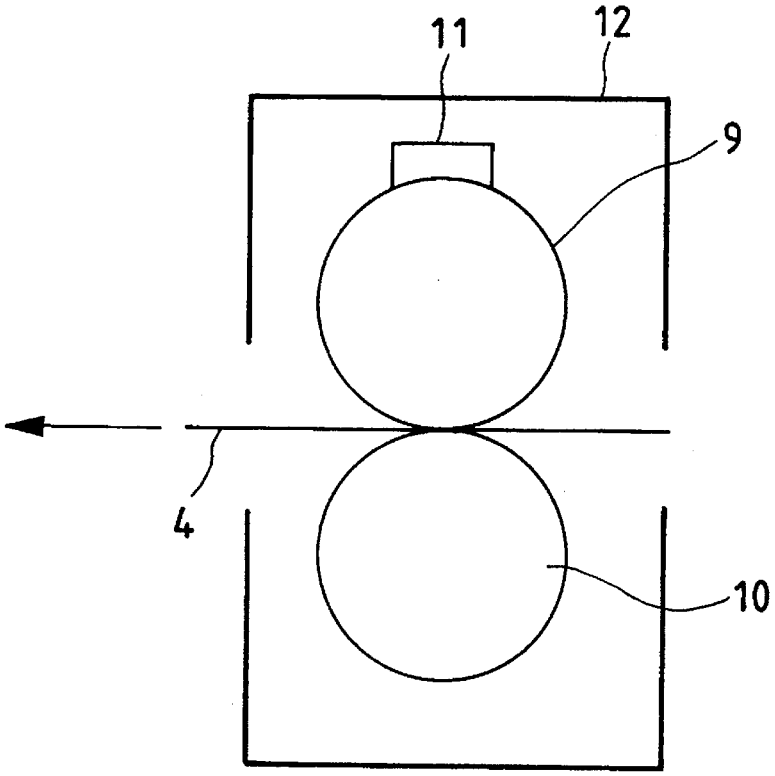
FIG. 2 illustrates a fixing step of an electrophotographic printing system.

The electrophotographic printing system is well known for which the printing paper of the present invention is useful. An example of the apparatus for the system is illustrated in FIG. 1 and FIG. 2. As shown in FIG. 1, a photoconductive photosensitive member 3 is electrically charged by means of a primary electric charger 5. Then the charged sensitive member is exposed to light image to form a latent image. The latent image is developed with a one-or two-component type toner 8 which is held in a developer 6 as the developing means to form a toner image. The toner image on the photosensitive member is transferred onto a printing paper sheet 4 fed from the outside, with a transfer charger 7 as the transfer means. Then, the toner image on the printing paper 4 is fixed by heat and/or pressure with a fixing device 12 as the toner device as shown in FIG. 2 which has a pair of rolls 9 and 10 (or one roll with one belt). Thus the final copied image is obtained.

In the transfer process, unfixed toner and paper dust formed from the printing paper sheet 4 are removed to clean the photosensitive member 3 by a cleaner device 1 placed after the transfer step. After the cleaning with a cleaning member 2 (e.g., a cleaning blade) in contact with the photosensitive member 3, the surface of the photosensitive member is repeatedly subjected to the steps of charging, etc. In the fixing device 12, as shown in FIG. 2, the unfixed toner and the paper dust from the transfer paper 4 on the fixation roll 9 are removed with the cleaning member 11 brought into contact therewith and simultaneously a releasing agent such as silicone oil is applied to the roller.

The above electrophotographic printing system is only one example for which the printing paper of the present invention is useful. The printing paper of the present invention can naturally be used in any other electrophotographic printing system.

The present invention is described more specifically by reference to examples and comparative examples. The units "part" and "%" are based on weight unless otherwise mentioned.

EXAMPLE 1

A mixture of 90 parts of LBKP and 10 parts of NBKP was used as the pulp material. The mixture was subjected to beating treatment. Thereto were added 10 parts of kaolin (manufactured by Tsuchiya Kaolin K.K.) as the ammonia-adsorbent substance, 0.2 parts of alkenylsuccinic acid anhydride, and 0.5 parts of cationic starch. Therefrom neutralized printing paper was prepared in a conventional manner. The resulting paper had a basis weight of 63 g/m$^2$, and a St öckigt sizing degree of 23 seconds. To the printing face of this printing paper, a 2% solution of a penetration-retarding agent having the composition below was applied as the surface sizing agent by air-spraying in an amount of 1 g/m$^2$.

| < Solid composition of penetration-retarding agent > | |
|---|---|
| Oxidized starch (MS-3800, manufactured by Nippon Shokuhin K.K.) | 95 parts |
| Styrene/maleic acid copolymer (Oxyloc, manufactured by Nippon Shokubai Kagaku Kogyo) | 5 parts |

Subsequently, the paper sheet was immersed in a sizepress coating solution containing 0.1% of sodium chloride, and was dried to obtain a sheet of Printing Paper A of the present invention. The resulting paper sheet contained sodium chloride at a content of 0.04 g/m$^2$ (0.06% by weight) and had a basis weight of 64 g/m$^2$.

OTHER EXAMPLES AND COMPARATIVE EXAMPLES

The content of sodium chloride (by weight) in the printing paper was changed by changing the concentration of sodium chloride in the sizepress coating solution as below.

0.006% (Printing Paper B, Comparative Example 1)

0.01% (Printing Paper C, Example 2)

0.03% (Printing Paper D, Example 3)

0.1% (Printing Paper E, Example 4)

0.15% (Printing Paper F, Example 5)

0.2% (Printing Paper G, Example 6)

0.25% (Printing Paper H, Comparative Example 2)

On the above printing paper sheets, images were formed by ink-jet printing and electrophotographic printing, and the images were evaluated as below:

<Image evaluation by ink-jet printing>

(1) Apparatus: Bubble-Jet type ink-jet printer (Printing density: 400 DPI)

(2) Ink composition I:

| | |
|---|---|
| Dye (black dye mixture (1:1:1) composed of the aforementioned exemplified compounds of Formulas (1), (2), and (3) | 3 parts |
| Diethylene glycol | 5 parts |
| Ethanol | 5 parts |
| Urea | 5 parts |
| Water | 82 parts |

(3) Evaluation:

Printing was conducted on the above printing paper sheets with the ink of Ink Composition I by means of the above apparatus. The bronzing at 100% solid print portions and feathering at the image boundary portion were evaluated visually. More specifically, the 100% solid printing portion of 50 mm×50 mm in size was examined by 7 persons visually for the bronzing and the feathering at the boundary portion between the black-printed portion and the white portion, and was evaluated on five grades with the criterions below:

1: Not practically useful at all

2: Problems involved for practical use

3: Barely acceptable for practical use

4: Acceptable for practical use

5: Excellent for practical use

The evaluation grades for bronzing and feathering were respectively averaged among 7 persons. The average value of 3.5 or higher is evaluated as 0K (acceptable), and that lower than 3.5 is evaluated as NG (not good).

<Image evaluation by electrophotographic printing>

(1) Apparatus and printing method:

With the electrophotographic printing apparatus as shown in FIG. 1, the photoconductive photosensitive member 3 was electrically charged by the primary charger 5, the drum is exposed to a light image to form an electrostatic latent image, the latent image was developed by the toner 8 having one-or two-components held in the developing device 6 to form a toner image, and the toner image was transferred by a transfer charger 7 onto the printing paper. The toner image was fixed by a fixing apparatus not shown in the drawing.

(2) Evaluation:

On the printing paper sheets, 100% solid image was printed by mean of the above apparatus. The printed image was evaluated visually regarding the state of the toner image transfer. The criterions for the evaluation were the same as in the above evaluation of bronzing and feathering in ink-jet printing.

The evaluation results are shown in Table 1.

TABLE 1

| Printing paper | Ink-jet printing Bronzing | Electrophotographic printing Feathering | Electrophotographic printing Image after transfer | Note* |
|---|---|---|---|---|
| A | OK | OK | OK | Ex. 1 |
| B | OK | OK | NG | Cmp. Ex. 1 |
| C | OK | OK | OK | Ex. 2 |
| D | OK | OK | OK | Ex. 3 |
| E | OK | OK | OK | Ex. 4 |
| F | OK | OK | OK | Ex. 5 |
| G | OK | OK | OK | Ex. 6 |
| H | NG | OK | NG | Cmp. Ex. 2 |

*Ex.: Example, Cmp. Ex.: Comparative Example

Further, for ink-jet printing, the same printing and evaluation were conducted as above with other Ink Compositions J, K, and L. The results were the same as above.

<Ink Composition J>

The dye of Formula (3) only was used in place of the dye mixture in Ink Composition I.

<Ink Composition K>

The dye was a mixture (1:1) of the dyes of Formula (1) and Formula (2), ethanolamine was used in place of urea in Ink Composition I.

<Ink Composition L>

The dye of Formula (5) only was used in place of the dye mixture in Ink Composition I.

Table 1 shows that Printing Paper sheets A, and C to G of the present invention are obviously superior to Printing Paper sheets B and H of Comparative Examples for electrophotographic printing and for ink-jet printing.

The transfer properties of Printing Paper sheet B of Comparative Example was improved by increasing the transfer electric current. Presumably, this is due to the fact that the electric resistance of the printing paper is higher at the smaller amount of sodium chloride and large electric current is required for the transfer.

The transfer properties of Printing Paper sheet H of Comparative Example was improved by decreasing the transfer electric current. Presumably, this is due to the fact that the electric resistance of the printing paper is too low at the larger amount of sodium chloride, and the excessively large electric current drives out the electric charge to weaken the electric field for the transfer. However, when the transfer current was adjusted to be suitable for such printing paper, the transfer became defective with other plain paper unpractically. The remarkable bronzing of Printing Paper H is probably due to dye deposition accelerated by a large amount of inorganic ions of sodium chloride.

From the above results, the content of sodium chloride (water-soluble inorganic salt) in the entire printing paper needs to be in the range of from 0.01 to 0.2% by weight in order to obtain printing paper which gives excellent images both by ink-jet printing and by electrophotographic printing.

In the above Examples, the weight ratio of the sodium chloride in the printing paper was controlled by the content of sodium chloride in the sizepress coating solution. The content is decided in consideration of the ratio of the sizepress coating solution taken up by the printing paper. In the above Examples, the content of 0.1% of sodium chloride in the sizepress coating solution gave 0.04 g/m$^2$ of sodium chloride deposition on the printing paper.

For adjusting the sodium chloride content in the printing paper, the sodium chloride concentration in the sizepress coating solution was adjusted in the above Examples. The method for adjusting the sodium chloride content, however, is not limited thereto. For example, the sodium chloride may be added to the aqueous solution of the penetration-retarding agent. The sodium chloride as used in Examples may be replaced by another inorganic salt to obtain the same result.

The dyes of Formulas (4), (6), (7), (8), and (9) as the dye for the ink of ink-jet printing give the same results.

EXAMPLE 7

As the starting pulp, 100 parts of LBKP was subjected to beating treatment. Thereto, were added 0.2 part of alkenylsuccinic anhydride, 0.5 part of cationic starch, and 6 parts by weight of kaolin as the filler. From the mixture paper sheet was produced by means of a Fourdrinier paper machine at a machine speed of 200 m/min. The resulting printing paper sheet had a basis weight of 73 g/m$^2$.

To this printing paper, an aqueous solution of a penetration-retarding agent containing 95 parts of oxidized starch and 5 parts of a styrene/maleic acid copolymer was applied in a sizepress coating step in an amount of 1 g/m$^2$, and then sodium chloride was applied in an amount of 0.1% in the same manner as in Example 4. Further the printing paper sheet was treated for calendering by adjusting the pressure to obtain the surface smoothness of 95 seconds to obtain Printing Paper I.

EXAMPLE 8

Printing Paper J was prepared in the same manner as in Example 7 except that the amount of the kaolin was changed to 4.5 parts.

EXAMPLE 9

Printing Paper K was prepared in the same manner as in Example 7 except that the amount of the kaolin was changed to 8 parts.

COMPARATIVE EXAMPLE 3

Printing Paper L of Comparative Example was prepared in the same manner as in Example 7 except that 6 parts of calcium carbonate was used in place of kaolin.

The above printing paper sheets were evaluated for suitability for electrophotographic printing and Ink-jet printing as below.

(1) Evaluation with electrophotographic printing apparatus:

The above Printing Paper sheets I to L were tested by continuous image formation of 100,000 sheets and 10,000 sheets with copying machine NP9800 and Color Copying Machine CLC300 (trade name; manufactured by Canon K.K.), respectively, and the failure in paper sheet feeding caused by feeding roller abrasion, defects of formed image caused by scratch of the fixing roll or the photosensitive drum, and failure of paper attraction at the transfer drum were observed.

Evaluation 1

The printing paper sheet which caused failure of paper sheet feed, or caused defects of images is evaluated as "poor", and the paper sheet which caused no failure or no defect was evaluated as "good".

Evaluation 2

The printing paper sheet which caused failure in attraction to the transfer drum, coming-off from the drum, or jamming of paper sheets was evaluated as "poor". The one which tended to come off from or to come to be attracted loosely by the transfer drum is evaluated as "fair". The one which does not cause any trouble is evaluated as "good".

(2) Evaluation with ink-jet printing Apparatus

The ink having the composition below was used for the evaluation.

<Ink Composition A>

| | |
|---|---|
| Dye (mixture (1:1:1) of exemplified compounds of Formulas (1), (2), and (3) where the counter ion is Li for Formulas (1) and (2), and Na for Formula (3)) | 3 parts |
| Diethylene glycol | 5 parts |
| Ethanol | 5 parts |
| Urea | 5 parts |
| Water | 82 parts |

Ink-jet printing was conducted by use of Printing Paper sheets I to L, and the ink of Ink Composition a with a printing apparatus provided with an ink-jet printing head having 14 nozzles per mm which eject ink droplets by action of heat. The printed images were evaluated as below. The results are shown in Table 2.

<Evaluation item>

Evaluation 3: Image Quality A straight line of one-dot breadth was printed in the direction of the head scanning. The line was evaluated visually at a distance of 25 cm.

The printing paper which gave a line having an unsharp edge or exhibited remarkable feathering was evaluated as "poor". The one which gave slight feathering but is acceptable practically was evaluated as "fair". The one which gave sharp straight line was evaluated as "good".

Evaluation 4: Bronzing

Solid printing was conducted on the whole face of the printing paper sheet with the aforementioned printing apparatus. The printing paper on which the printed portion was recognized to be black is evaluated as "good". The one which caused slight bronzing but was acceptable for practical use was evaluated as fair. The one which caused bronzing and formed brown spots was evaluated as "poor".

TABLE 2

| Printing paper | Filler Material | Filler Parts | Evaluation: Copying machine Item 1 | Copying machine Item 2 | Ink-jet Item 3 | Ink-jet Item 4 |
|---|---|---|---|---|---|---|
| I | Kaolin | 6 | good | good | good | good |
| J | Kaolin | 4.5 | good | good | good | good |
| K | Kaolin | 8 | good | good | good | good |
| L | Calcium carbonate | 6 | poor | good | fair | fair |

Table 2 shows clearly that the Printing Paper sheets I to K of the present invention are clearly superior to Printing Paper sheet L of Comparative Example as the printing paper both for electrophotographic printing and for ink-jet printing.

EXAMPLE 10

As the starting pulp, 100 parts of LBKP was subjected to beating treatment. Thereto, were added 10 parts of kaolin, 0.2 part of alkenylsuccinic anhydride, and 0.5 part of cationic starch. From the mixture paper sheet was produced by means of a Fourdrinier paper machine as shown in FIG. 3 at a machine speed of 200 m/min and dehydration conditions of 500 m/min.

The resulting printing paper sheet had a basis weight of 73 g/m$^2$ and Stökigt sizing degree of 23 seconds. The wild formation variation ratio of the paper was 3.8%, and the wild formation portion had average diameter of 15 mm as a circle, and the thickness difference was about 17 μm.

To this printing paper, an aqueous solution of a penetration-retarding agent containing 95 parts of oxidized starch and 5 parts of a styrene/maleic acid copolymer was applied in a sizepress coating step in an amount of 1 g/m$^2$, and then sodium chloride was applied in the same manner as in Example 4. Further the printing paper sheet was treated for calendering by adjusting the pressure to obtain the surface smoothness of 95 seconds to obtain Printing Paper M. The thickness difference of wild formation thereof decreased to about 7 μm, and the opacity was 86%.

EXAMPLE 11

Printing Paper sheet N was prepared with the same formulation as in Example 10 except that the drainage rate was 400 m/min under the paper machine speed of 800 m/min, upon drainaging with a wire part of the paper machine as shown in FIG. 3.

The obtained printing paper sheet had a wild formation variation ratio of 4.2%, and the wild formation portion had average diameter of 1.5 mm as a circle. The surface smoothness was 102 seconds, the opacity was 89%.

EXAMPLE 12

Printing Paper sheet P was prepared with the same formulation as in Example 10 except that the aqueous solution of the penetration-retarding agent AKD was changed to 100 parts, the amount of the polyoxyethylene laurylphosphate is changed to 0.2 part, and the feed of the raw material (stock) from the stock inlet of the paper machine as shown in FIG. 3 was increased to obtain a paper sheet of basis weight of 85 g/m$^2$. The area ratio and the size of the wild formation portion were the same level as those of Printing Paper sheet M, and the thickness difference of the wild formation was 23 μm.

Subsequently, the paper sheet was smoothened at the calendering part of the paper machine in FIG. 3 to a surface smoothness of 120 seconds, and the thickness difference of the wild formation portion of 8 μm. Thereby Printing Paper sheet P of the present invention was obtained. The opacity thereof was 92%.

<Evaluation >

(1) Evaluation by electrophotographic printing apparatus:

On the Printing Paper sheets M, N, and P, images were formed by a copying machine NP9800 and CLC500 (each manufactured by Cannon K.K.) as the electrophotographic printing apparatus. The evaluations were made as below. The evaluation results are shown in Table 3.

Evaluation Item:

(i) Irregularity in transfer:

A mono-color solid image was printed on the paper sheet with the above printing apparatus by adjusting the optical density of 0.6 as measured by a McBeth densitometer. The solid printing was examined visually. The printing paper which gave a low image density portion in comparison with the peripheral portion of the image was evaluated as "poor".

The one which gave a uniform image without irregularity in image transfer was evaluated as "good".

(ii) Print roughness:

A pale magenta color image of 200 lines was formed at an optical density of 0.6 as measured by a McBeth densitometer on the paper sheet. The paper sheet which gave an irregular line image with white spots was evaluated as "poor". The one which gave a line image with feathering was evaluated as "fair". The one which gave an image without white spots and roughness of the image was evaluated as "good".

(iii) Strike-through of image:

Solid images of magenta, cyan, and yellow were formed respectively at an optical density of 0.6 as measured by a McBeth densitometer. The images were observed from backside of the paper sheet. When the color portions could be discriminated at the backside, the paper was evaluated as "poor". When the color portions could not be discriminated, the paper was evaluated as "good".

(2) Evaluation by ink-jet printing apparatus:

Image quality

A straight line of one-dot breadth was printed in the direction of the head scanning. The line was evaluated visually at a distance of 25 cm.

The printing paper which gave a line having an unsharp edge or exhibited remarkable feathering was evaluated as "poor". The one which gave sharp straight line was evaluated as "good".

Bronzing

Solid printing was conducted on the whole face of the printing paper sheet with the aforementioned printing apparatus. The printing paper on which the printed portion was recognized to be black is evaluated as "good". The one on which bronzing occurred and brown spots were observed was evaluated as "poor".

The results are shown in Table 3.

As described above, the present invention provides neutralized paper useful for both ink-jet printing and electrophotographic printing capable of forming uniform image without irregular ink absorption and without irregular toner transfer.

TABLE 3

| | | Evaluation by | | | Evaluation by electrophotographic printing | | |
|---|---|---|---|---|---|---|---|
| | | Ink-jet printing | | | Transfer | Print | |
| Printing paper | Ink | Image quality | Bronzing | Strike-through | irregularity | roughness | Strike-through |
| M (Example 10) | a | good | good | good | good | good | good |
| N (Example 11) | a | good | good | good | good | good | good |
| P (Example 12) | a | good | good | good | good | good | good |
| M (Example 10) | b | good | good | good | good | good | good |
| M (Example 10) | c | good | good | good | good | good | good |
| M (Example 10) | d | good | good | good | good | good | good |

The ink having the composition below was used for the evaluation.

<Ink composition>

Ink a:

| | |
|---|---|
| Dye (mixture (1:1:1) of exemplified compounds of Formulas (1), (2), and (3) where the counter ion is Li for Formulas (1) and (2), and Na for Formula (3)) | 3 parts |
| Diethylene glycol | 5 parts |
| Ethanol | 5 parts |
| Urea | 5 parts |
| Water | 82 parts |

Ink b:

The same as ink a except that the dye was composed only of the compound of Formula (3).

Ink c:

The same as ink a except that the dye was a mixture (1:1) of the compounds of Formulas (1) and (2), and urea was replaced by monoethanolamine.

Ink d:

The same as ink a except that the dye was composed only of the compound of Formula (5).

Ink-jet printing was conducted by use of Printing Paper sheets M, N, and P, and Inks a, b, c, and d with a printing apparatus provided with an ink-jet printing head having 14 nozzles per mm which eject ink droplets by action of heat. The printed images were evaluated for printing suitability as below. The results are shown in Table 3.

<Evaluation Item>

What is claimed is:

1. A printing paper suitable for use in ink-jet recording systems making use of an ink containing a nitrogen compound, comprising a base paper containing as a filler, a material which absorbs ammonia or ammonium ions released by the nitrogen compound in the ink, and an ink penetration-retarding agent provided on the base paper, wherein the printing paper has a water extract pH of not lower than 6 and a Stöckigt sizing degree of from 16 to 40 seconds, and contains a water-soluble inorganic salt on a surface thereof in an amount ranging from 0.01 to 0.2% by weight.

2. The printing paper according to claim 1, wherein the water-soluble inorganic salt is at least one selected from the group consisting of sodium chloride, magnesium chloride, and potassium chloride.

3. The printing paper according to claim 1, wherein the material which absorbs ammonia or ammonium ions is contained in an amount ranging from 4 to 9% by weight.

4. The printing paper according to claim 1, wherein the material which absorbs ammonia or ammonium ions is synthetic aluminum silicate or a kaolinite.

5. The printing paper according to claim 1, wherein the paper has wild formation variation ratio of not more than 6%, and an opacity of not less than 85%.

6. The printing paper according to claim 1, wherein the paper has wild formation variation ratio of not more than 4.5%.

7. The printing paper according to claim 1, wherein the paper has a surface smoothness ranging from 80 to 200 seconds.

8. The printing paper according to claim 1, wherein the ink penetration-retarding agent is a material selected from the group consisting of casein, starch, carboxymethylcellulose, hydroxyethylcellulose, polyvinyl alcohol, polyvinyl pyrrolidone, sodium polyacrylate, polyacrylamide, styrene-butadiene rubber, acrylic resin, styrene-maleic acid copolymer, styrene-acrylic acid copolymer, silicone oil, paraffin wax and fluorine compound.

9. The printing paper according to claim 1, which has a water extract pH not lower than 7.

10. The printing paper according to claim 1, which further contains a cationic compound.

11. The printing paper according to claim 10, wherein said cationic compound is a material selected from the group consisting of polyvinylamine, polyallylamine, polydiallylamine, polydimethylaminoethyl methacrylate and salts thereof; cationically-modified polyvinyl alcohol, polyvinylpyrrolidone, polyacrylamide; cationized hydroxyethylcellulose, and cationized starch.

12. The printing paper according to claim 1, which has a surface electric resistance in the range of from $10^9$ to $10^{12}$ Ω.

13. The printing paper according to claim 1, which has a basis weight ranging from 60 to 90 g/m$^2$.

14. The printing paper according to claim 1, which has a density ranging from 0.6 to 0.8 g/m$^3$.

15. The printing paper according to claim 1, wherein the ink penetration-retarding agent is applied to the surface of the base paper in a proportion of 0.1 to 3 g/m$^2$.

16. The printing paper according to claim 1, wherein the material which absorbs ammonia or ammonium ions is contained in an amount ranging from 6 to 8% by weight.

17. The printing paper according to claim 1, which has an opacity higher than 85%.

18. A printing paper suitable for use in ink-jet recording systems making use of an ink containing a nitrogen compound; comprising a base paper containing as a filler, synthetic aluminum silicate or kaolinite, and a material selected from the group consisting of casein, starch, carboxymethylcellulose, hydroxyethylcellulose, polyvinyl alcohol, polyvinylpyrrolidone, sodium polyacrylate, polyacrylamide, styrene-butadiene rubber, acrylic resin, styrene-maleic acid copolymer, styreneacrylic acid copolymer, silicone oil, paraffin wax and fluorine compound, provided on the base paper, wherein the printing paper has a water extract pH of not lower than 6 and a Stöckigt sizing degree of from 16 to 40 seconds, and contains a water-soluble inorganic salt on a surface thereof in an amount ranging from 0.01 to 0.2% by weight.

19. The printing paper according to claim 18, which has a water extract pH not lower than 7.

20. The printing paper according to claim 18, which further contains a cationic compound.

21. The printing paper according to claim 20, wherein said cationic compound is a material selected from the group consisting of polyvinylamine, polyallylamine, polydiallylamine, polydimethylaminoethyl methacrylate and salts thereof; cationically-modified polyvinyl alcohol, polyvinylpyrrolidone, polyacrylamide; cationized hydroxyethylcellulose, and cationized starch.

22. The printing paper according to claim 18, which has a surface electric resistance in the range of from $10^{19}$ to $10^{12}$ Ω.

23. The printing paper according to claim 18, which has a basis weight ranging from 60 to 90 g/m$^2$.

24. The printing paper according to claim 18, which has a density ranging from 0.6 to 0.8 g/m$^3$.

25. The printing paper according to claim 18, wherein the ink penetration-retarding agent is applied to the surface of the base paper in a proportion of 0.1 to 3 g/m$^2$.

26. The printing paper according to claim 18, wherein the filler is contained in an amount ranging from 4 to 9% by weight.

27. The printing paper according to claim 18, wherein the filler is contained in an amount ranging from 6 to 8% by weight.

28. The printing paper according to claim 18, wherein the water-soluble inorganic salt is at least one selected from the group consisting of sodium chloride, magnesium chloride and potassium chloride.

29. The printing paper according to claim 18, which has an opacity of higher than 85%.

* * * * *

UNITED STATES PATENT AND TRADEMARK OFFICE

CERTIFICATE OF CORRECTION

PATENT NO. : 5,620,793 Page 1 of 2

DATED : April 15, 1997

INVENTOR(S) : AKIO SUZUKI ET AL.

It is certified that error appears in the above-identified patent and that said Letters Patent is hereby corrected as shown below:

COLUMN 1

Line 43, "hands," should read --hand,--; and
Line 46, "JP-A-2-" should read --JP-B-2- --.

COLUMN 2

Line 39, "paper;" should read --paper,--; and
Line 40, "comprising" should read --comprising:--

COLUMN 10

Line 61, "form" should read --from--.

COLUMN 11

Line 42, "St" should read --Stöckigt; and
Line 43, delete "öckigt".

COLUMN 12

Line 47, "0K" should read --OK--.

UNITED STATES PATENT AND TRADEMARK OFFICE

CERTIFICATE OF CORRECTION

PATENT NO. : 5,620,793 Page 2 of 2

DATED : April 15, 1997

INVENTOR(S) : AKIO SUZUKI ET AL.

It is certified that error appears in the above-identified patent and that said Letters Patent is hereby corrected as shown below:

COLUMN 15

Line 8, "Apparatus" should read --apparatus--;
Line 11, "<Ink Composition A>" should read --<Ink Composition a>--; and
Line 28, "Image Quality A" should read --Image Quality. A--.

COLUMN 20

Line 1, "styreneacrylic" should read --styrene-acrylic--; and
Line 20, "$10^{19}$" should read --$10^{9}$--.

Signed and Sealed this

Thirtieth Day of December, 1997

Bruce Lehman

*Attest:*

BRUCE LEHMAN

*Attesting Officer*

*Commissioner of Patents and Trademarks*